US005102308A

United States Patent [19]

Bordelon

[11] Patent Number: 5,102,308

[45] Date of Patent: Apr. 7, 1992

[54] AXIAL FLOW PUMP

[76] Inventor: Thomas Bordelon, 3005 DeLambert, Chalmette, La. 70043

[21] Appl. No.: 581,982

[22] Filed: Sep. 14, 1990

[51] Int. Cl.[5] ..... F04B 21/00

[52] U.S. Cl. ..... 417/423.13; 415/110; 417/424.1

[58] Field of Search ..... 417/365, 423.9, 423.11, 417/423.12, 423.13, 423.14, 424.1; 415/104, 107, 110, 111, 112; 384/453, 504, 609

[56] References Cited

U.S. PATENT DOCUMENTS

| | | | |
|---|---|---|---|
| 2,604,077 | 7/1952 | Nast | 417/423.13 X |
| 2,888,193 | 5/1959 | Greenwald | 417/423.13 X |
| 3,137,237 | 6/1964 | Zagar et al. | 417/423.11 |
| 3,249,057 | 5/1966 | Callahan | 417/423.12 |
| 3,847,504 | 11/1974 | Martin | 417/423.12 X |

FOREIGN PATENT DOCUMENTS

| | | | |
|---|---|---|---|
| 3331466 | 3/1985 | Fed. Rep. of Germany | 415/110 |
| 3543669 | 6/1987 | Fed. Rep. of Germany | 415/112 |

*Primary Examiner*—Leonard E. Smith
*Attorney, Agent, or Firm*—Keaty & Keaty; Thomas S. Keaty

[57] ABSTRACT

The invention relates to an axial flow pump installation and utilizes a motor for transmitting a torque to a rotary shaft extending from the motor to a bearing house. Mounted within the bearing house and circumferentially engaging the motor are a pair of thrust bearings and a radial floating bearing spaced a distance above the thrust bearings. A thrust retaining tube press fit between the floating bearing and the pair of thrust bearings retains the pre-determined distance between those bearings. The lower, thrust bearings bear a primary shaft thrust load, while the upper, floating bearing minimizes vibration of the shaft. A lubricant circulation passageways are formed for continuous circulating of the lubricant from a high pressure side to a low pressure side of a pump.

12 Claims, 1 Drawing Sheet

AXIAL FLOW PUMP

BACKGROUND OF THE INVENTION

The present invention relates to axial flow pumps and in particular to an axial low lift pump with improved anti-vibration characteristics.

Pumps and specifically axial flow propeller pumps have been used for many applications, such as flood control, drainage, irrigation, transfer pumping, the watering of excavations and the like. Such pumps are often connected to primary mover, such as an electrical or a pneumatic motor and, through a connected shaft, transfer rotating power to a propeller to facilitate transfer of liquids. It has been observed that during operation, the shafts are subject to increasing temperature due to friction despite the fact that thrust bearings are heavily lubricated. Another phenomenon which has been detected and which many designers attempted to solve is elimination of transverse movement, that is vibration of the shaft during high rotation speed operations. Still, the problem of vibration has not been completely eliminated and the problem of premature bearing failure causes frequent and costly repairs of the pump.

The present invention contemplates elimination of drawbacks associated with the conventional pumps and provision of an improved pump installation.

SUMMARY OF THE INVENTION

The present invention achieves it objects and overcomes shortcomings of the art in a simple and straightforward manner.

An axial flow pumping apparatus is provided which comprises a motor, such as a hydraulic motor, mounted within a motor housing, a bearing housing connected to a lower portion of the motor housing and having an opening extending therethrough to receive a rotary shaft therein. Mounted about a rotary shaft adjacent of the bottom of the bearing housing is a pair of thrust bearings which are coupled together and rotate as a unit. The thrust bearings bear a primary shaft thrust load imparted on the propeller unit driven by the motor.

A floating bearing is positioned a distance above the thrust bearings and is retained in its spaced apart vertical relationship by a thrust tube which is press fit between an upper surface of the thrust bearings and the bottom surface of the floating radial bearing.

The bottom surface of the thrust bearing rests on an upwardly facing shoulder of an inner wall of the cylindrical retaining sleeve placed within the interior of the bearing housing in co-axial alignment.

The present invention also contemplates provision of a continuous lubricant circulation line which allows lubricant, such as oil to enter the rotary shaft through a radial port made at a location of the shaft portion within the motor housing and which is in fluid communication with a central axial opening extending through a part of the rotary shaft to a distance below the thrust bearings. A second radial port is formed in the shaft in fluid communication with a central axial bore and communicates with the central opening of the bearing housings, allowing the oil to move downwardly through the shaft and be forced upwardly through the bearing housing. A drain passageway is connected between the motor housing and the bearing housing to recirculate the oil to a low pressure side of a hydraulic reservoir.

The floating bearing is allowed to move radially to a limited degree, so as to accommodate and minimize vibration of the rotary shaft during rotation. No means to limit upward thrust of the floating bearing are provided, in contrast to other designs of pumping installations.

A better understanding of the invention will be heard from the following description of the preferred embodiment of the present invention.

BRIEF DESCRIPTION OF THE DRAWINGS

Reference will now be made to the drawings, wherein like parts are designated by like numerals, and wherein.

DETAILED DESCRIPTION OF THE PREFERRED EMBODIMENT

Figure 1:
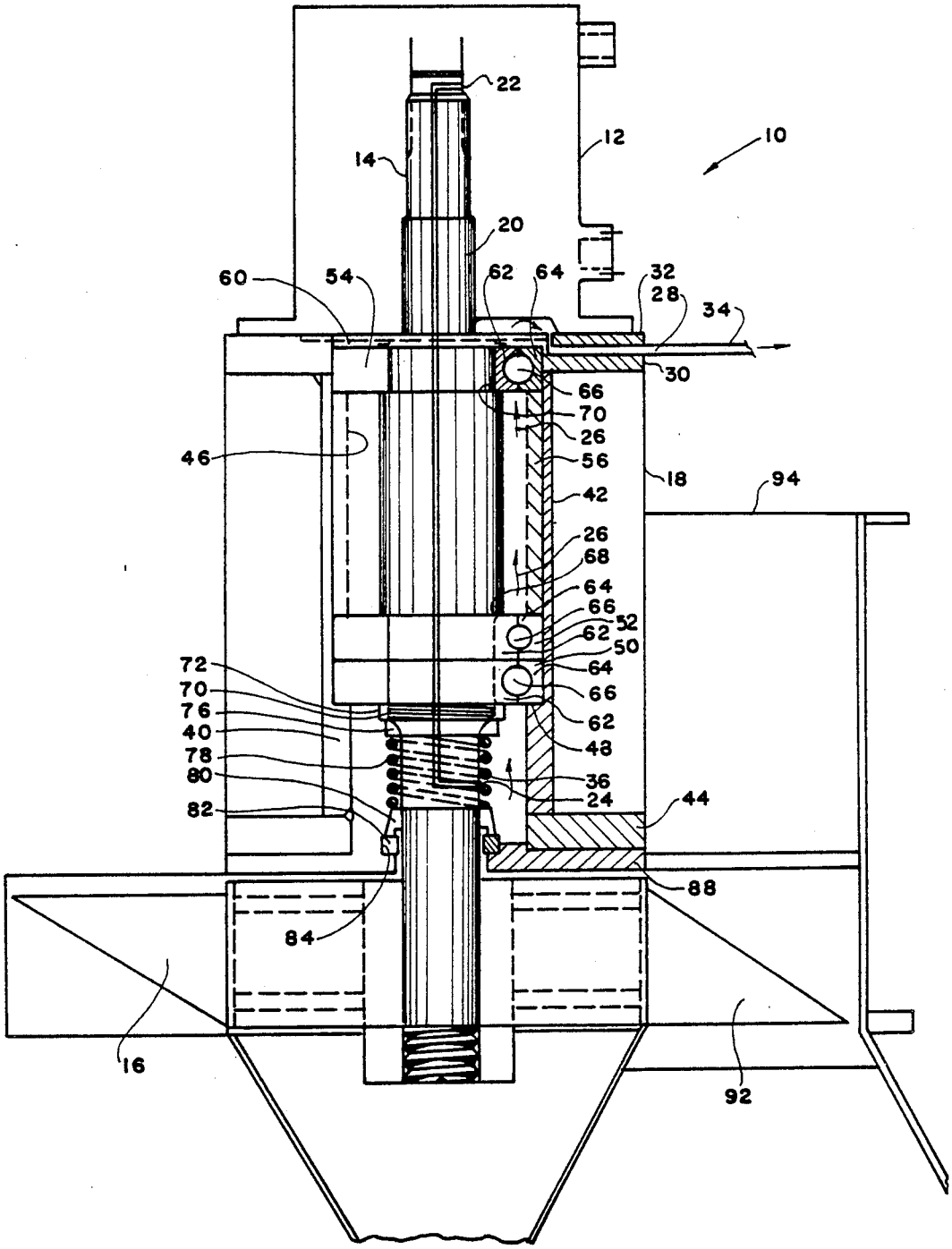
FIGURE 1 is a detail, partially cross sectional view illustrating an improved pump installation and bearing assembly in accordance with the present invention.

Referring now to the drawings in more detail, numeral 10 is seen to designate an axial flow pump in accordance with the present invention. As can be seen in the drawing, the pumping assembly comprises a hydraulic motor or other prime mover drive unit 12, which houses an upper end of a rotating shaft 14 therein and transmits torque for rotation of a pump propeller assembly 16. Mounted between the motor unit 12 and the propeller assembly 16 is a bearing housing 18 which is designed to house a middle part of the shaft 14 and allow circulation of lubricating oil therethrough.

The shaft 14 is formed with an axial opening 20 which extends from an upper part of the rotary driving shaft 14 and fluidly communicates with an upper radial opening 22 and with a lower radial opening 24. The opening 24 is located adjacent a lower part of the shaft 14 and adjacent a bottom portion of the bearing housing 18. The lubricating oil enters the axial bore 20 through the port 22 and flows downwardly to exit through the port 24 and then changes direction and moves upwardly in the direction of arrows 26 about the circumference of the shaft 14 and finally exits the housing 18 through a specially provided leak or drain port 28 formed between a top plate 30 of the bearing housing 18 and the bottom plate 32 of the motor housing 12. The oil exiting the leak port 28 is either conducted back to the low side of the hydraulic pump or, through a conduit 34, to the surface, where it is collected, cooled, filtered and recirculated through the casing 18 without assistance of any additional mechanical equipment, such as complicated pumping or tubing.

The port 24 is formed in the area of a lower mechanical seal 36, the details of which will be described hereinafter, which allows the lubricating oil to lubricate the shaft 14, the bearing assembly, the description of which follows below, as well as the lower mechanical seal assembly.

Referring now in more detail to the bearing assembly, the housing 18 can be seen formed with a cylindrical central opening 40 through which the shaft 14 extends. Mounted within the central opening 40 is a cylindrical reinforcing sleeve 42, the upper end of which abuts the lower surface of the top plate 30, while the lower end of which abuts an upper surface of the bottom plate 44 of the bearing housing 18. A counter bore 46 is formed within the sleeve 42 and terminates, at its lower portion, in the upwardly facing shoulder 48, while extending at its upper end to the uppermost limits of the sleeve 42.

Resting on the shoulder 48 is a thrust bearing 50 which is coupled in its operation with a thrust bearing 52 mounted immediately above the thrust bearing 50. Both thrust bearings 50 and 52 are designed to take upward and downward thrust of the shaft 14 during rotation.

Mounted adjacent an upper end of the housing 18 is a radial floating bearing 54 which is spaced from the thrust bearing 52 and is retained in the spaced-apart relationship by a thrust retaining tube 56, the external diameter of which is slightly smaller than the internal diameter of the counter bore 46 and whose internal diameter is smaller than the diameter of the bearings 50, 52 and 54. The thrust retaining tube 56 is press fit in the counter bore 46 between the bearings 52 an 54 and is designed to stabilize the vertical thrust. The tube 56 is machined to the exact size or even slightly greater and by effecting the difference of temperature (during assembly) between the bearing assembly and the thrust tube 56, the tube 56 is precisely fitted within the counter bore 46 and retains its ring surface area sufficient to overcome the upward thrust of the propeller 16. The provision of the thrust tube 56 allows to hold an upwardly directed thrust without any other retaining means such as caps, or clips on top of the floating bearing 54.

As will be appreciated, the bearings 50, 52 and 54 are designed to withstand axial thrusts of the pump shaft 14. In addition, the bearing 54, by being spaced above the lower set of bearings 50 and 52 allows to practically eliminate vibration, that is transverse movement of the shaft 14 during rotation. The floating bearing 54, as can be seen in the drawing, has a limited space 60 within which it can move slightly upwardly on the shaft 14 to accommodate expansion under heating of the axial elements of the bearing assembly. The shaft 14 therefore, is stabilized in two vertically-spaced locations which advantageously affects the rotating of the shaft and minimizes the vibration of the shaft 14.

The bearings 50, 52 and 54 have similar construction, inasmuch as they comprise inner races 62 which engage the pump shaft 14, annular outer races 64 which sit within the counter bore 46 and balls 66 which are engaged radially between the races 62 and 64.

The outer races 64 of the bearings 52 and 54 engage the lower and upper ends, respectively, of the thrust retaining tube 56, while the inner races 62 of the bearings 52 and 54 engage transverse annular flanges 68 and 70, respectively, on the pump shaft 14.

A mechanical shaft seal 36 is provided between the lower bearing 50 and the bottom plate 44 of the bearing housing 18. As can be seen in the drawing, the part of the shaft below the bearing 50 is threaded, as at 70 and is engaged with a retaining nut 72.

Mounted about the shaft 14 below the retaining nut 72 is an annular spacer 76 which engages with its upper surface the bottom surface of the retaining nut 72. Urging against the bottom of the spacer 76 is a compression spring 78 which urges by its lowermost end against an upper end of a retainer ring 80. The retaining nut 72, annular spacer 70 and the lower retainer ring 80 are fixedly connected to the shaft 14 in circumferential relationship thereto and rotate therewith.

The bottom retainer ring 80 is engaged and contacts an annular bottom spacer 82 which is fitted within a counter bore 84 of a bottom retainer plate 88 of the bearing housing 18. A flexible seal, such as O-ring 90 is fitted between the counter bore 84 and the spacer 82 to provide a fluid tight seal around the pump shaft 14. The mechanical seal 36 is designed to prevent foreign matter from entering the bearings 50, 52 and 54 and adversely effecting their ability to freely rotate and hold the axial thrust of the propeller assembly 16.

The lower part of the shaft 14 carries a propeller assembly 16 which is provided with a plurality of spaced apart blades 92 which are designed to propel the water by transmitting the driving force from the shaft 14 to the water within which the propellers 92 are submerged. The water displaced by propeller blades 92 flows upwardly through the casing 94 towards the surface when the pump unit 10 is in operation. During operation, a pressure is built up while the motor does not impart rotation. A pair of anti-cavitation check valves are connected to the motor. A manually adjusted , pressure valve is gradually operated to relieve the return line of pressure. Then the shaft is allowed to start rotating.

The oil is continuously circulated through the port 22, opening 20, port 24 and draining passageway 34 from and back to a hydraulic reservoir (not shown), insuring smooth rotation of the rotor shaft and associated bearings.

Many changes and modifications can be made within the design of the present invention without departing from the spirit thereof.

I therefore pray that my rights to the present invention be limited only by the scope of the appended claims.

I claim:

1. A pumping apparatus, comprising:

a motor means;

a substantially cylindrical bearing housing means having a central opening extending therethrough and coaxially attached to a lower part of said motor means, said bearing housing means having an inner wall provided with an upwardly facing shoulder;

a rotary shaft extending from said motor means through the central opening of said bearing housing means;

a pump means receiving a lower part of the shaft means and connected to a lower portion of said bearing housing means;

a thrust bearing means resting on the inner wall shoulder of said bearing housing means and circumferentially mounted about said rotary shaft;

a floating radial bearing means mounted a distance above said thrust bearing means and separated from said thrust bearing means by a thrust retaining tube, said tube retaining a predetermined distance between said thrust bearing means and said floating radial bearing means; and a lubricant circulation means said lubricant recirculation means comprising a lubricant flow line extending axially through at least a part of said rotary shaft for directing a lubricant to a point below said thrust bearing means and a lubricant return line in fluid communication with said lubricant flow line, said lubricant return line being mounted between said motor means and said bearing housing means for directing the lubricant in a continuous flow to a low pressure side of a hydraulic reservoir.

2. A pumping apparatus, comprising:

a motor means positioned within a motor housing means;

a substantially cylindrical bearing housing means having a central opening extending therethrough and co-axially attached to a lower part of said motor housing means, said bearing housing means having an inner wall provided with an upwardly facing shoulder, said motor housing means being provided with a bottom plate which is fixedly attached to a top plate of said bearing housing means;

a rotary shaft extending from said motor means through said motor housing means into said central opening of said bearing housing means, said rotary shaft being provided with a central aperture extending along its longitudinal axis through at least a part of said rotary shaft;

a pump means receiving a lower part of the shaft means and connected to a bottom plate of said bearing housing means;

a thrust bearing means resting on the inner wall shoulder and circumferentially mounted about said rotary shaft mounted in said bearing housing means; and a means for stabilizing position of said rotary shaft during rotation, said stabilizing means being mounted a distance above said thrust bearing means in circumferential wherein a radial opening is formed in the rotary shaft at a level below said thrust bearing means to allow fluid communication between said central aperture of the rotary shaft and the bearing housing means.

3. A pumping apparatus, comprising:

a motor means positioned within a motor housing means;

a substantially cylindrical bearing housing means having a central opening extending therethrough and co-axially attached to a lower part of said motor housing means, said bearing housing means having an inner wall provided with an upwardly facing shoulder, said motor housing means being provided with a bottom plate which is fixedly attached to a top plate of said bearing housing means;

a rotary shaft extending from said motor means through said motor housing means into said central opening of said bearing housing means, said rotary shaft being provided with a central aperture extending along its longitudinal axis through at least a part of said rotary shaft;

a pump means receiving a lower part of the shaft means and connected to a bottom plate of said bearing housing means;

a thrust bearing means resting on the inner wall shoulder and circumferentially mounted about said rotary shaft mounted in said bearing housing means; and a means for stabilizing position of said rotary shaft during rotation, said stabilizing means being mounted a distance above said thrust bearing means in circumferential relationship to said rotary shaft;

wherein a radial opening is formed int he rotary shaft at a level below said thrust bearing means to allow fluid communication between said central aperture of the rotary shaft and the bearing housing means; and wherein a flow passageway is formed between the bottom plate of the motor housing means and the top plate of the bearing housing means, and wherein a lubricant drainage line is connected to said flow passageway to allow circulation of the lubricant from said bearing housing means back to a hydraulic reservoir.

4. A pumping apparatus, comprising:

a motor means;

a substantially cylindrical bearing housing means having a central opening extending therethrough and co-axially attached to a lower part of said motor means, said bearing housing means having an inner wall provided with an upwardly facing shoulder;

a rotary shaft extending from said motor means through the central opening of said bearing housing means;

a pump means receiving a lower part of the shaft means and connected to a lower portion of said bearing housing means;

a thrust bearing means resting on the inner wall shoulder of said bearing housing means and circumferentially mounted about said rotary shaft; and a floating radial bearing means mounted a distance above said thrust bearing means and separated from said thrust bearing means by a thrust retaining tube, said tube retaining a predetermined distance between said thrust bearing means and said floating radial bearing means, said floating radial bearing means being adapted for a limited upward movement along said rotary shaft, so as to accommodate expansion under heating during operation.

5. The apparatus of claim 4, further comprising a lubricant recirculation means.

6. The apparatus of claim 4, wherein said floating radial bearing means has a bottom surface which rests on a top end of said thrust retaining tube, and wherein a bottom end of said thrust retaining tube abuts a top surface of said thrust bearing means.

7. The device of claim 4, wherein said floating bearing means is adapted for a limited radial movement in relation to said rotary shaft to accommodate vibration of said rotary shaft during operation.

8. The apparatus of claim 4, wherein said thrust bearing means comprises a pair of thrust bearings coupled together for rotation as a unit and adapted to bearing a primary shaft thrust load.

9. A pumping apparatus, comprising:

a motor means positioned within a motor housing means;

a substantially cylindrical bearing housing means having a central opening extending therethrough and co-axially attached to a lower part of said motor housing means, said bearing housing means having an inner wall provided with an upwardly facing shoulder, said motor housing means being provided with a bottom plate which is fixedly attached to a top plate of said bearing housing means;

a rotary shaft extending from said motor means through said motor housing means into said central opening of said bearing housing means, said rotary shaft being provided with a central aperture extending along its longitudinal axis through at least a part of said rotary shaft, so as to allow fluid communication of the rotary shaft with the bearing housing means;

a pump means receiving a lower part of the shaft means and connected to a bottom plate of said bearing housing means;

a thrust bearing means resting on the inner wall shoulder and circumferentially mounted about said rotary shaft mounted in said bearing housing means; and a means for stabilizing position of said rotary shaft during rotation, said stabilizing means being mounted a distance above said thrust bearing means in circumferential relationship to said rotary shaft.

10. The apparatus of claim 9, wherein said means for stabilizing position of the rotary shaft comprise a floating bearing means adapted for synchronized rotation along with said rotary shaft within said bearing housing means.

11. The apparatus of claim 9, further comprising a thrust retaining tube having a lower end which abuts a top surface of said thrust bearing means and an upper end, on which a bottom surface of said floating bearing means rests.

12. The apparatus of claim 9, wherein said thrust bearing means comprises a pair of thrust bearings coupled together for rotation as a unit and adapted to bear a primary shaft thrust load.

* * * * *